US008512016B2

(12) United States Patent
Suzuki et al.

(10) Patent No.: US 8,512,016 B2
(45) Date of Patent: Aug. 20, 2013

(54) POSITIVE-DISPLACEMENT DRY PUMP

(75) Inventors: Toshio Suzuki, Chigasaki (JP); Tomonari Tanaka, Chigasaki (JP)

(73) Assignee: Ulvac, Inc., Chigasaki-Shi (JP)

( * ) Notice: Subject to any disclaimer, the term of this patent is extended or adjusted under 35 U.S.C. 154(b) by 0 days.

(21) Appl. No.: 13/389,070

(22) PCT Filed: Aug. 11, 2010

(86) PCT No.: PCT/JP2010/063606

§ 371 (c)(1),
(2), (4) Date: Feb. 6, 2012

(87) PCT Pub. No.: WO2011/019048

PCT Pub. Date: Feb. 17, 2011

(65) Prior Publication Data

US 2012/0134867 A1 May 31, 2012

(30) Foreign Application Priority Data

Aug. 14, 2009 (JP) ..... P2009-187974

(51) Int. Cl.
*F03C 2/00* (2006.01)
*F03C 4/00* (2006.01)
*F04C 2/00* (2006.01)

(52) U.S. Cl.
USPC ..... 418/9; 418/132; 418/201.1; 418/206.1

(58) Field of Classification Search
USPC ..... 418/9, 131–132, 201.1, 206.1–206.8
See application file for complete search history.

(56) References Cited

U.S. PATENT DOCUMENTS

| | | | | |
|---|---|---|---|---|
| 2,691,945 | A * | 10/1954 | Wichorek | 418/132 |
| 3,890,068 | A * | 6/1975 | Davidson | 418/132 |
| 6,572,351 | B2 | 6/2003 | Durand et al. | |
| 7,278,839 | B2 * | 10/2007 | Liu et al. | 418/9 |
| 7,491,041 | B2 * | 2/2009 | Imai et al. | 418/9 |
| 2004/0091380 | A1 | 5/2004 | Kriehn et al. | |

FOREIGN PATENT DOCUMENTS

| | | |
|---|---|---|
| JP | 53-143105 | 11/1978 |
| JP | 2-70990 | 3/1990 |
| JP | 8-100778 | 4/1996 |
| JP | 2003-166483 | 6/2003 |
| JP | 2004-506140 | 2/2004 |
| JP | 2004-507641 | 3/2004 |

OTHER PUBLICATIONS

International Search Report from corresponding PCT Application No. PCT/JP2010/063606 dated Sep. 7, 2010.

* cited by examiner

*Primary Examiner* — Theresa Trieu
(74) *Attorney, Agent, or Firm* — Grossman, Tucker, Perreault & Pfleger, PLLC

(57) ABSTRACT

The present invention provides a dry pump including: a center cylinder which includes: a plurality of pump chambers containing an upper stage pump chamber that communicates with an intake port and a lower stage pump chamber that communicates with a discharge port; a plurality of rotors contained in the plurality of the pump chambers; a rotating shaft that is a rotation axis of the rotor; and a side face on which a communication hole is formed, the side face being intersected by the rotating shaft extending in the axial direction, and being provided adjacent to the lower stage pump chamber, and a side cover which covers the side face with the communication hole to form a space.

4 Claims, 7 Drawing Sheets

POSITIVE-DISPLACEMENT DRY PUMP

TECHNICAL FIELD

The present invention relates to a positive-displacement dry pump.

This application claims priority from Japanese Patent Application No. 2009-187974 filed on Aug. 14, 2009, the contents of which are incorporated herein by reference in their entirety.

BACKGROUND ART

For performing vacuuming, dry pumps have conventionally been used. The dry pump is provided with a pump chamber in which a rotor is contained in a cylinder. The dry pump performs vacuuming by rotating the rotor in the cylinder, and compressing and moving an exhaust gas so as to reduce the pressure of a sealed space at an intake port (for example, refer to Patent Document 1). Specifically, in a case where vacuuming is performed so as to obtain a medium vacuum or an excellent vacuum in the sealed space, a multiple-stage dry pump is used in which a center cylinder includes a plurality of pump chambers which are connected in series from the exhaust gas intake port to a discharge port (for example, refer to Patent Document 2).

When the dry pump is driven, the exhaust gas is compressed in the pump chamber and heat is generated, and the temperature of the cylinder thereby rises. For example, in a case where vacuuming is performed so as to obtain a general, preferable pressure by the multiple-stage dry pump, the inner pressure of a pump chamber provided near an air side (discharge side) becomes higher than the inner pressure of a pump chamber provided near a vacuum side. Accordingly, the amount of heat generation increases in the pump chamber provided at the air side.

A multiple-stage dry pump is well-known in which: an outer peripheral gas passage is cooled by a cooling liquid tank; and a counter flow port that can introduce a part of gas that flows through the outer peripheral gas passage into the pump chamber is formed (for example, refer to Patent Document 3). This method for cooling a pump chamber, which is a so-called counter flow cooling, can suppress the rising of the temperature of the pump chamber by introducing (flowing back) a part of gas cooled by the cooling liquid tank.

RELATED ART DOCUMENTS

Patent Documents

[Patent Document 1] Published Japanese Translation No. 2004-506140 of the PCT International Publication

[Patent Document 2] Japanese Unexamined Patent Application, First Publication No. 2003-166483

[Patent Document 3] Japanese Unexamined Patent Application, First Publication No. H8-100778

DISCLOSURE OF THE INVENTION

Problems to be Solved by the Invention

However, the above-described multiple-stage dry pump, which is the counter flow cooling type, needs to form the counter flow port between the outer peripheral gas passage and the pump chamber, and thus, the structure of the center cylinder becomes complicated. Accordingly, problems arise regarding a manufacturing cost and a work burden for maintenance.

The present invention is made to solve the above problems, and the object thereof is to provide a dry pump that can increase the vacuuming efficiency by curing an uneven temperature which is locally generated, at low cost.

Means for Solving the Problems

In order to solve the above-described problems, the present invention provides the following dry pump.

That is, a dry pump of the present invention includes: a center cylinder which includes: a plurality of pump chambers containing an upper stage pump chamber that communicates with an intake port and a lower stage pump chamber that communicates with a discharge port; a plurality of rotors contained in the plurality of the pump chambers; a rotating shaft that is a rotation axis of the rotor; and a side face on which a communication hole is formed, the side face being intersected by the rotating shaft extending in the axial direction, and being provided adjacent to the lower stage pump chamber, and a side cover which covers the side face with the communication hole to form a space.

In the dry pump of the present invention, the communication hole may communicate the space with a pump chamber having a maximum pressure among the plurality of the pump chambers each having different inner pressures.

In the dry pump of the present invention, the space may be defined by the side face and a recessed portion which is formed on the side cover.

In the dry pump of the present invention, the space may be defined by the side cover and a recessed portion which is formed on the side face.

In the dry pump of the present invention, an outer face of the side cover may be formed with an uneven section.

Effects of the Invention

The dry pump generates heat due to the compression work of the rotor and the like. As to the amount of heat generation in each of the pump chambers, in a case where vacuuming is performed so as to obtain a general, preferable pressure, the closer a pump chamber is to the air side pump chamber (discharge side pump chamber) with a pressure near the attained pressure, the higher the inner pressure is. In the dry pump of the present invention, a part of gas which flows into the pump chambers flows into a space (airtight region) formed between a side cover and a side face of the center cylinder, through a communication hole formed on the side face of the center cylinder.

Since the side cover is in contact with an outside air at a large area, the heat in the space promptly disperses through the side cover. That is, it is possible to effectively suppress the rising of the temperature of the pump chamber where the amount of heat generation is large, by introducing a part of the gas which has been flowed into the pump chamber into the space.

EMBODIMENTS OF THE INVENTION

Figure 1:
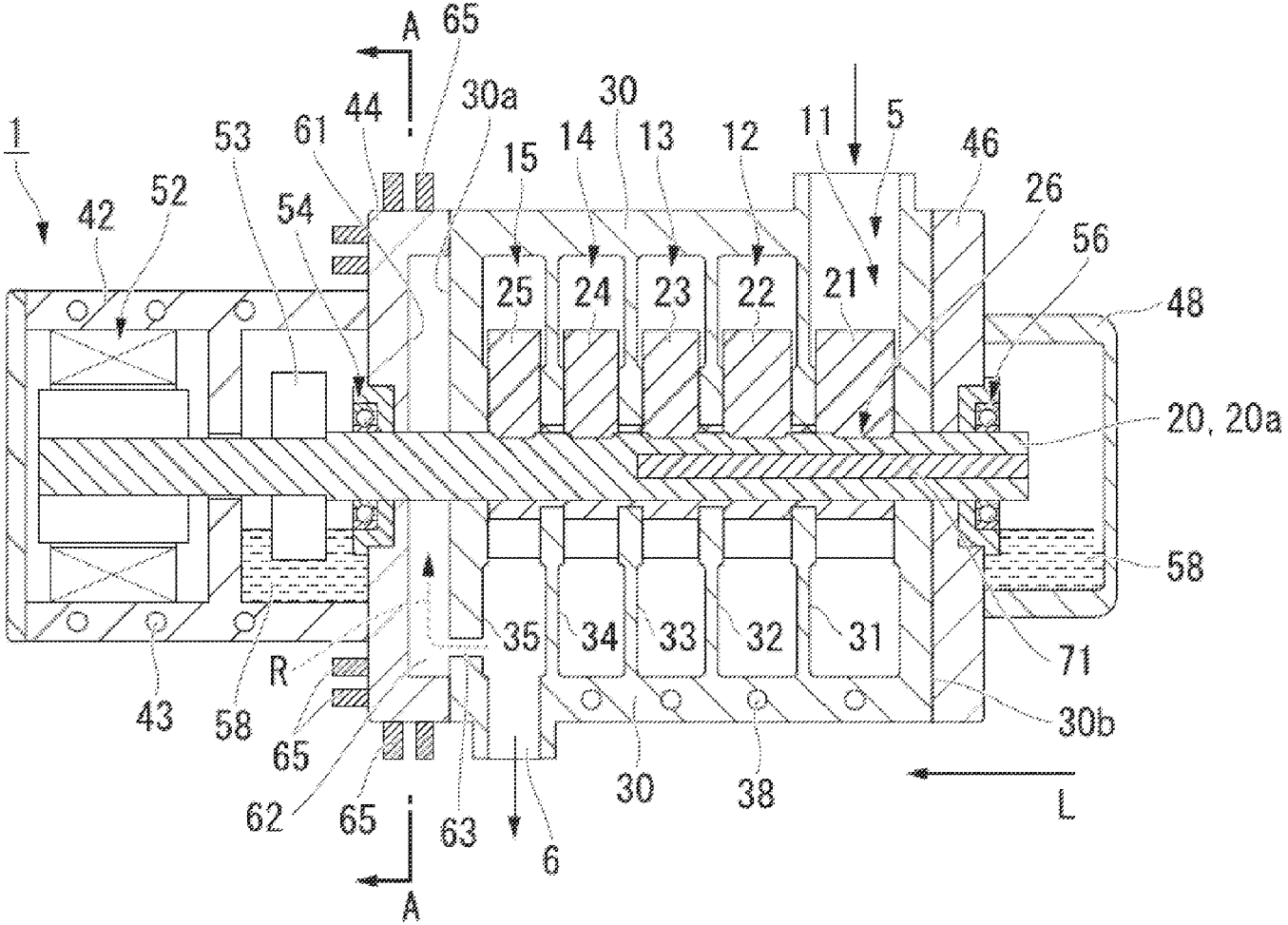
FIG. 1 is a cross-sectional side view showing a dry pump related to the present invention.

Hereinafter, an embodiment of a dry pump related to the present invention will be described with reference to drawings. The embodiment is specifically explained for appropriate understanding of the scope of the present invention. The technical scope of the invention is not limited to the below embodiments, but various modifications may be made without departing from the scope of the invention. Additionally, in the respective drawings referred to in the below explanation, in order to make the respective components be of understandable size in the drawing, the dimensions and the proportions of the respective components are modified as needed compared with the real components.

Figure 2:
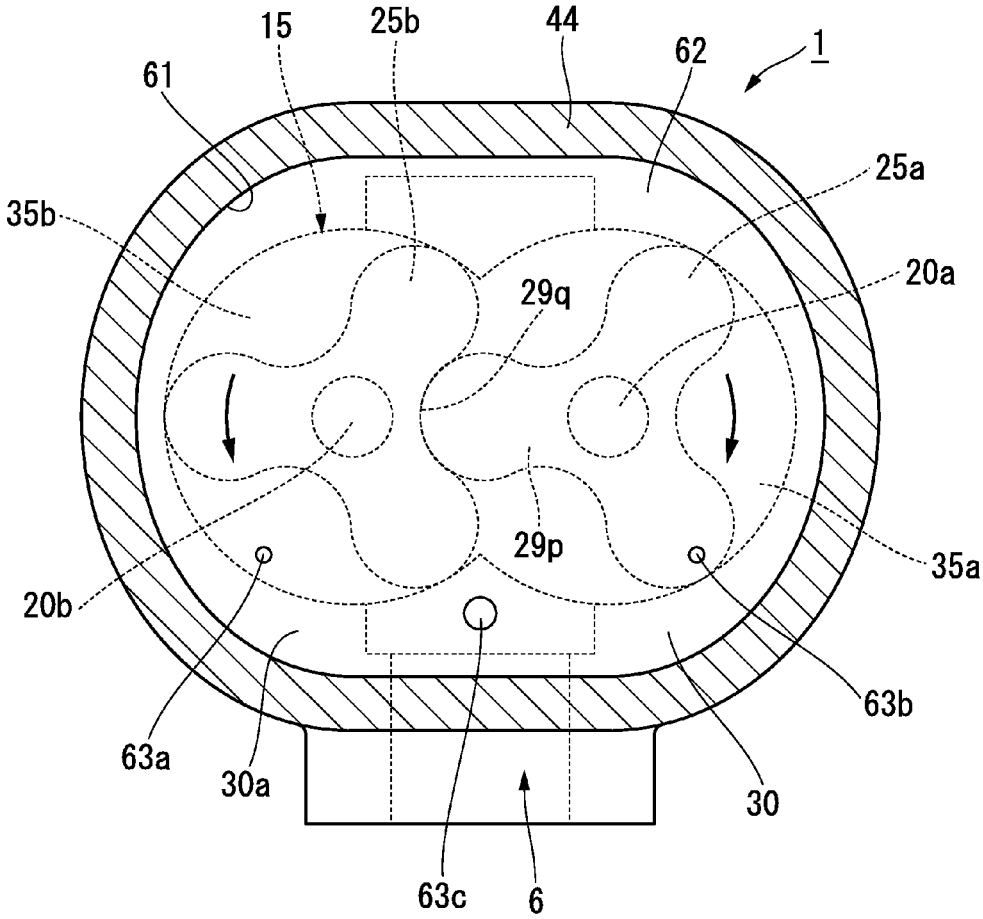
FIG. 2 is a cross-sectional front view showing a dry pump related to the present invention.
Figure 3:
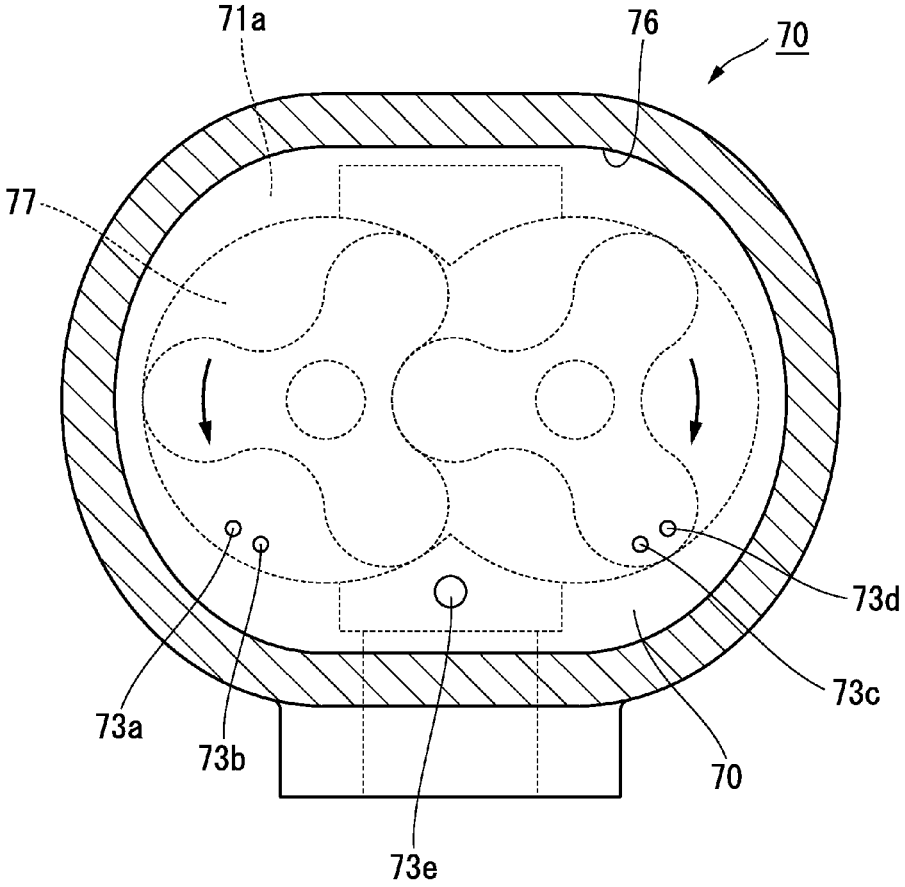
FIG. 3 is a cross-sectional front view showing a modification of a dry pump related to the present invention.

FIG. 1 is a cross-sectional side view showing a dry pump related to the present invention. FIG. 2 is a cross-sectional front view taken along the line A-A shown in FIG. 1. A multiple-stage dry pump 1 is provided with a center cylinder 30, a side cover 44 (first side cover), and an auxiliary side cover 46 (second side cover). The side cover 44 and the auxiliary side cover 46 are respectively fixed to side faces 30*a* and 30*b* of the center cylinder 30. The center cylinder 30 is formed with cylinders 31, 32, 33, 34, and 35.

In the dry pump 1, rotors 21, 22, 23, 24, and 25 having a different thickness from each other are contained in the cylinders 31, 32, 33, 34, and 35, respectively. In addition, a plurality of pump chambers 11, 12, 13, 14, and 15 are formed along the axial direction L of a rotating shaft 20.

The dry pump 1 is provided with a pair of rotors 25*a* and 25*b*, and a pair of rotating shafts 20*a* and 20*b*. The pair of rotors 25*a* and 25*b* are arranged such that a protuberance portion 29*p* of one rotor 25*a* (first rotor) is engaged with a recessed portion 29*q* of the other rotor 25*b* (second rotor). In cylinders 35*a* and 35*b*, the rotors 25*a* and 25*b* rotate along with rotation of the rotating shafts 20*a* and 20*b*. When each of the rotating shafts 20*a* and 20*b* rotates in the inverse direction to each other, the gas between the protuberance portions 29*p* of each of the rotors 25*a* and 25*b* transfers along the inner surface of the cylinders 35*a* and 35*b*, and is compressed.

A plurality of the rotors 21 to 25 are arranged along the axial direction L of the rotating shaft 20. Each of the rotors 21 to 25 is engaged with a groove 26 formed at an outer peripheral face of the rotating shaft 20, and the transferring thereof in the circumferential direction and the axial direction is regulated. A plurality of the pump chambers 11 to 15 are configured in which the rotors 21 to 25 are contained in the cylinders 31 to 35, respectively. The multiple-stage dry pump 1 is configured in which the pump chambers 11 to 15 are connected in series from the exhaust gas intake port 5 toward the discharge port 6.

In a plurality of the pump chambers 11 to 15, a first stage pump chamber (upper stage pump chamber) 11 which communicates with the intake port 5 is a vacuum side pump chamber, namely, a low pressure side pump chamber. Additionally, a fifth stage pump chamber (lower stage pump chamber) 15 which communicates with the discharge port 6 is an ordinary pressure side pump chamber, namely, a high pressure side pump chamber. Furthermore, a second stage pump chamber 12 (middle stage pump chamber), a third stage pump chamber 13 (middle stage pump chamber), and a fourth stage pump chamber 14 (middle stage pump chamber) are provided between the first stage pump chamber (upper stage pump chamber) 11 and the fifth stage pump chamber (lower stage pump chamber) 15. With this configuration, since an exhaust gas is compressed and the pressure rises from the first stage pump chamber 11 of the intake port 5 (vacuum side, low pressure stage) to the fifth stage pump chamber 15 of the discharge port 6 (air side, high pressure stage), the displacement amount decreases in incremental steps in the pump chambers. Specifically, the gas compressed in the first stage pump chamber 11 at the vacuum side flows into the second stage pump chamber 12. The gas compressed in the second stage pump chamber 12 flows into the third stage pump chamber 13. The gas compressed in the third stage pump chamber 13 flows into the fourth stage pump chamber 14. The gas compressed in the fourth stage pump chamber 14 flows into the fifth stage pump chamber 15. The gas compressed in the fifth stage pump chamber 15 is evacuated from the discharge port 6. For this reason, a gas supplied from the intake port 5 is gradually compressed through the pump chambers 11 to 15, and evacuated from the discharge port 6.

Each of the displacement amounts of the pump chambers 11 to 15 is proportional to a scraping-out volume by the rotor and a rotating speed. Since the scraping-out volume by the rotor is proportional to the number of blades of the rotor (the number of protuberance portions) and the thickness thereof, each thickness of the rotor is determined such that the thickness thereof is gradually thinned from the low pressure stage pump chamber 11 toward the high pressure stage pump chamber 15. In addition, in the dry pump 1 of the embodiment, the first stage pump chamber 11 is disposed near a free bearing 56 which is described below, and the fifth stage pump chamber 15 is disposed near a fixed bearing 54.

The cylinders 31 to 35 are formed inside the center cylinder 30. A side cover 44 is fixed to one end portion 30*a* in the axial direction L of the center cylinder 30, and an auxiliary side cover 46 is fixed to the other end portion 30*b* in the axial direction L of the center cylinder 30. Bearings 54 and 56 are fixed to the side cover 44 and the auxiliary side cover 46, respectively.

The first bearing 54 fixed to the side cover 44 is a bearing having a little looseness in the axial direction such as an angular contact bearing or the like, and serves as a fixed bearing 54 regulating the movement of the rotating shaft in the axial direction. It is preferable that a motor housing 42 fixed to the side cover 44 include oil 58 for the fixed bearing 54. On the other hand, the second bearing 56 fixed to the auxiliary side cover 46 is a bearing having a great looseness in the axial direction such as a ball bearing or the like, and serves as a free bearing 56 allowing the movement of the rotating shaft in the axial direction. The fixed bearing 54 rotatably supports the near center portion of the rotating shaft 20, and the free bearing 56 rotatably supports the near the end portion of the rotating shaft 20.

A cap 48 is attached to the auxiliary side cover 46 so as to cover the free bearing 56. It is preferable that the cap 48 include oil 58 for the free bearing 56 therein. Meanwhile, the motor housing 42 is fixed to the side cover 44.

A motor 52 such as a DC brushless motor or the like is disposed inside the motor housing. The motor 52 applies a revolution driving force (torque) to only the rotating shaft 20*a* (first rotating shaft) in a pair of the rotating shafts 20*a* and 20*b*. The revolution driving force (torque) is transmitted to the rotating shaft 20*b* (second rotating shaft) via a timing gear 53 placed between the motor 52 and the fixed bearing 54.

A cooling medium path 38 is formed on the outer peripheral portion of the center cylinder 30. For example, water which serves as a cooling medium passes through the cooling medium path 38, thereby cooling the pump chambers 12 to 15.

The side cover 44 includes a recessed portion 61 inwardly formed from a surface being in contact with a side face 30*a* of the center cylinder 30 toward the axial direction L of the rotating shaft 20. The side cover 44 is fixed to the side face 30*a* of the center cylinder 30 at the outside of the recessed portion 61, that is, at the peripheral portion thereof. With this configuration, a space (airtight region) 62, which is defined by the recessed portion 61 and the side face 30*a* of the center cylinder 30, is formed between the side cover 44 and the side face 30*a* of the center cylinder 30.

In addition, the outer peripheral face of the side cover 44 is formed with an uneven section 65. The uneven section 65 increases the surface area of the outer peripheral face of the side cover 44. Then, the uneven section 65 can disperse the heat of the side cover 44 conducted from the space 62, thereby increasing the heat dissipation performance. That is, the effect of cooling the space 62 by the outside air can be promoted.

On the other hand, the side face 30*a* of the center cylinder 30 is formed with a communication hole 63 that communicates the space 62 with the pump chamber 15 adjacent to the space 62. The communication hole 63 enables a part of the gas to move (flow in and flow out) between the space 62 and the pump chamber 15 which is the highest pressure side pump chamber among the pump chambers 11 to 15 having different inner pressures to each other.

A plurality of the communication holes 63 may be formed on the side face 30*a* of the center cylinder 30. For example, in FIG. 2, the region near the discharge port 6 is formed with three communication holes 63 in total, two of which being relatively small communication holes 63*a* and 63*b*, and one of which being a communication hole 63*c* which is larger than the communication hole 63*a* or 63*b*.

Driving the dry pump 1 according to the above embodiment, the dry pump 1 generates heat due to the compression work of the rotor and the like. Then, the amount of heat generation in each of the pump chambers 11 to 15 increases as the pump is closer to the high pressure side pump chamber (discharge side pump chamber) which has a higher inner pressure. That is, the amount of heat generation proportionally increases from the pump chamber 11 to the pump chamber 15, and the fifth stage pump chamber provided at the high pressure side will have the highest temperature.

However, according to the dry pump 1 according to this embodiment, a part of the gas that flows into the fifth stage pump chamber 15 from the fourth stage pump chamber 14 flows into the space 62 which is formed between the side cover 44 and the side face 30*a* of the center cylinder 30, through the communication hole 63 formed on the side face 30*a* of the center cylinder 30 (refer to the broken arrow R in FIG. 1).

Since the side cover 44 is in contact with the outside air at a large area, and further the surface area of the side cover 44 increases due to the uneven section 65 formed thereon, the heat generated at the recessed portion 61 of the side cover 44 promptly disperses through the side cover 44. This makes it possible to effectively suppress the rising of the temperature of the fifth stage pump chamber 15 where the amount of heat generation is the largest, by introducing a part of the gas flowed into the fifth stage pump chamber 15 into the space 62.

In addition, the cooling of the fifth stage pump chamber 15 provided at the air side (high pressure stage) can be realized merely by forming a space 62 by the side cover 44 with a recessed portion 61, and forming a communication hole 63 between the side face 30*a* of the center cylinder 30 and the fifth stage pump chamber 15. Therefore, it is possible to realize a dry pump which can reliably cool a pump chamber provided at the air side (high pressure stage) with a simple structure at low cost.

Meanwhile, the number of the communication holes 63 and an arrangement pattern may be suitably selected in accordance with the rising of the temperature of the pump chamber provided at the air side (high pressure stage). For example, a side face 71*a* of a center cylinder 71 of a dry pump 70, which is a modification of the present invention, is provided with five communication holes 73 in total, four of which being communication holes 73*a*, 73*b*, 73*c*, and 73*d* each having a relatively small size, and one of which being a communication hole 73*e* having a size larger than the communication hole 73*a*, 73*b*, 73*c*, or 73*d*. This makes it possible to increase the flowability of the gas between the space 76 and the pump chamber 77 which is provided at the air side (high pressure stage), thereby improving the effect of suppressing the rising of the temperature of the pump chambers 77.

Figure 4:
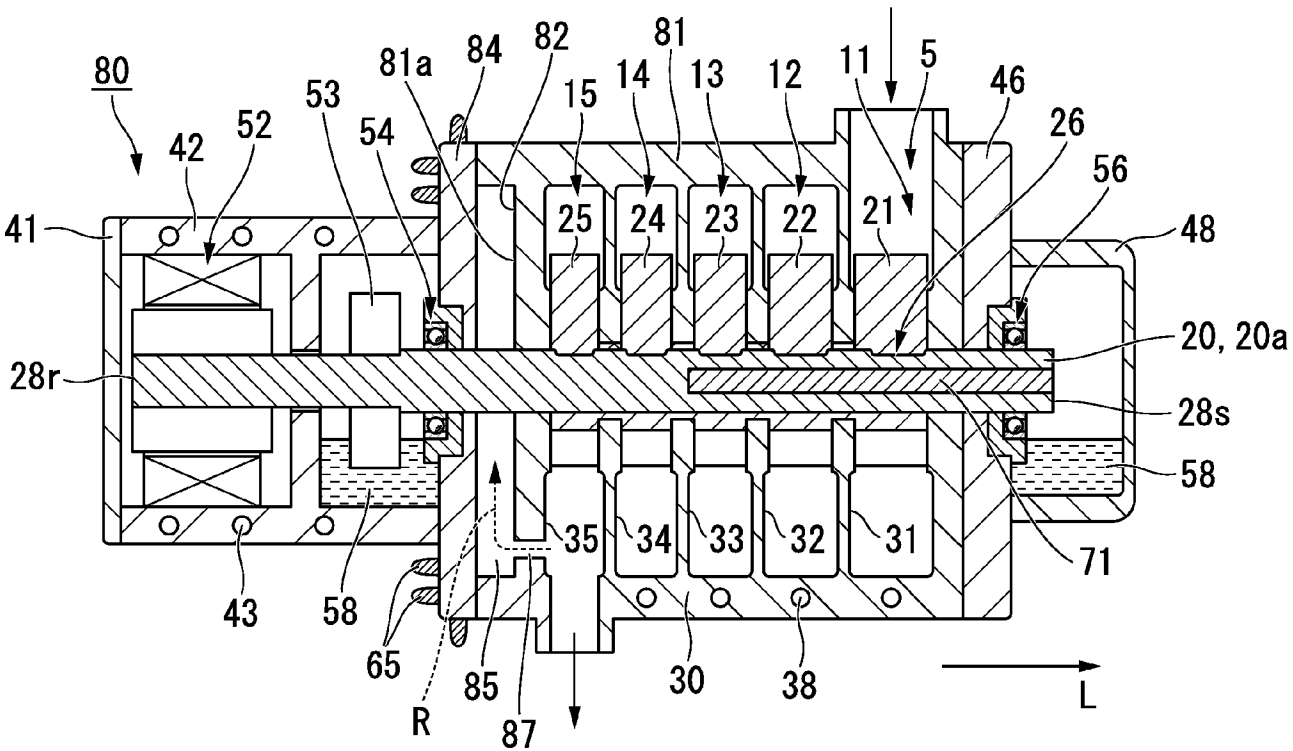
FIG. 4 is a cross-sectional side view showing a modification of a dry pump related to the present invention.

The space can be provided not only by forming a recessed portion on the side cover, but also by forming the recessed portion on the side face of the center cylinder. FIG. 4 is a cross-sectional side view showing a modified embodiment of the present invention. Elements corresponding to elements explained in the embodiment as shown in FIG. 1 are referenced by the same reference numerals and the repeated description thereof is omitted. In a dry pump 80, a recessed portion 82 is inwardly formed at a side face 81*a* of a center cylinder 81 in the axial direction L of the rotating shaft 20. With this configuration, a space 85 which is defined by the recessed portion 82 and the side cover 84 is formed between the side cover 84 and the side face 81*a* of the center cylinder 81.

On the other hand, the side face 81*a* of the center cylinder 81, more specifically, a lower part of the recessed portion 82 is formed with a communication hole 87 which communicates the space 85 with a pump chamber 15 which is provided adjacent to the space 85. In this dry pump 80 with the above configuration, the heat can be dispersed through the side cover 84 by introducing a part of the gas which is introduced into the fifth stage pump chamber 15 into the space 85. This makes it possible to effectively suppress the rising of the temperature of the fifth stage pump chamber 15 where the amount of heat generation is the largest in a case that vacuuming is performed so as to obtain a general, preferable pressure.

EXAMPLES

Hereinafter, Examples which were conducted for verifying the effects of the present invention will be explained. As Examples of the present invention, as shown in FIGS. 1 and 2, dry pumps including a space 62 formed between a side face 30*a* of a center cylinder 30 and a side cover 44, and communication holes 63 that communicate the pump chamber 15 with the space 62 which are adjacent to each other, were used. Two types of dry pumps, one of which having a communication hole with a relatively large size (opening diameter) and the other of which having a communication hole with a relatively small size, were prepared.

Furthermore, as Comparative Example, a conventional dry pump not having a space or a communication hole was prepared.

By driving two dry pumps of Example of the present invention and one dry pump of Comparative Example while varying the pressure of the intake port gradually, the vacuuming speed, the power, and the temperature of the pump chamber were measured. The measurement results are shown in FIGS. 5A to 5C.

Figure 5A:
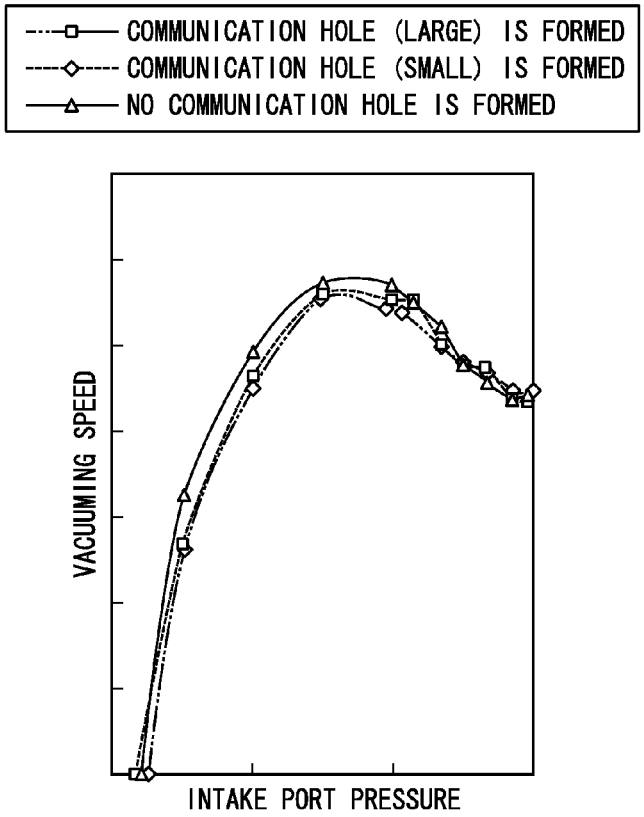
FIG. 5A is a graph showing a relationship between an intake port pressure and a vacuuming speed.
Figure 5B:
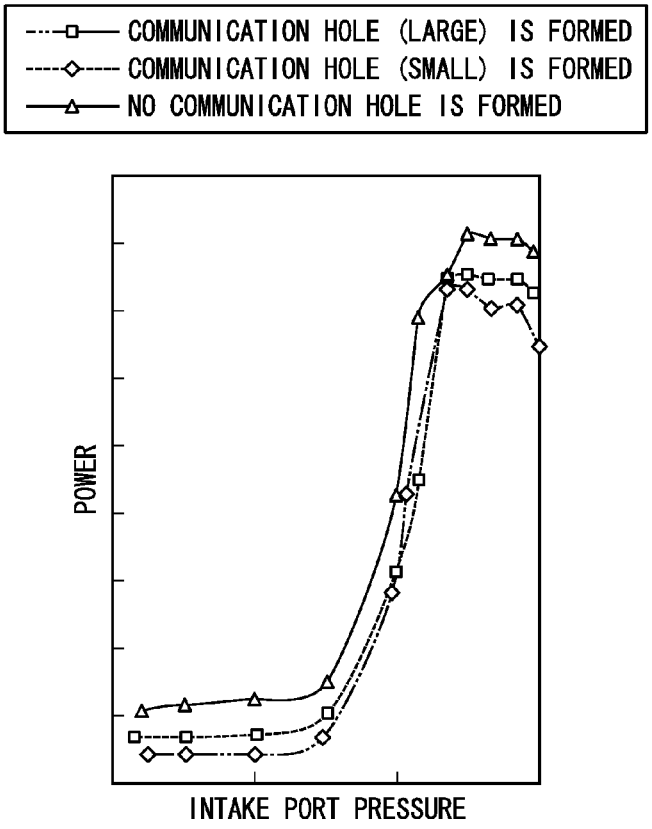
FIG. 5B is a graph showing a relationship between an intake port pressure and a power.
Figure 5C:
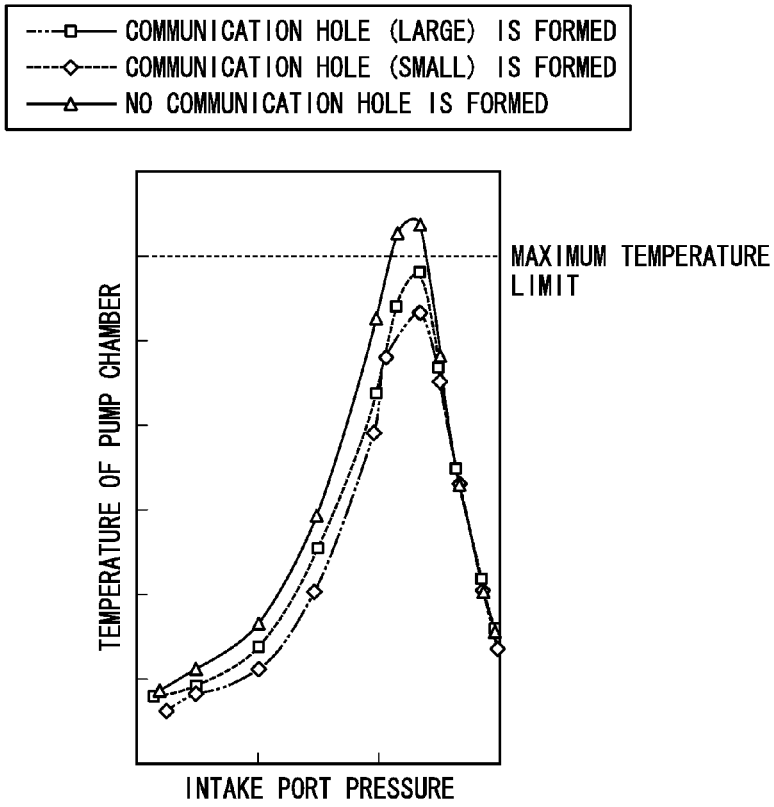
FIG. 5C is a graph showing a relationship between an intake port pressure and a temperature of a pump chamber.

According to the verified results shown in FIGS. 5A to 5C, it was confirmed that the dry pumps of the Examples of the present invention including communication holes that communicate the pump chamber with the space can reduce the power and the temperature of the pump chamber when compared with the dry pump of the Comparative Examples. Particularly, it was confirmed that the larger the size (opening diameter) of the communication hole is, the higher the effect (effect of cooling) is. In addition, it was confirmed that the vacuuming speed does not significantly decrease even though the communication hole was formed.

INDUSTRIAL APPLICABILITY

The present invention can provide a dry pump that can improve the vacuuming efficiency by curing an uneven temperature which is locally generated, at low cost. Accordingly, the present invention sufficiently provides industrial applicability.

REFERENCE SYMBOL LIST

1 DRY PUMP
5 INTAKE PORT
6 DISCHARGE PORT
11 to 15 PUMP CHAMBERS
30 CENTER CYLINDER
30*a* SIDE FACE
44 SIDE COVER
46 AUXILIARY SIDE COVER
61 RECESSED PORTION
62 SPACE (AIRTIGHT REGION)
65 UNEVEN SECTION

What is claimed is:

1. A dry pump comprising:

a center cylinder which includes:

a plurality of pump chambers containing an upper stage pump chamber that communicates with an intake port and a lower stage pump chamber that communicates with a discharge port;

a plurality of rotors contained in the plurality of the pump chambers;

a rotating shaft that is a rotation axis of the rotor;

a side face on which a communication hole is formed, the side face being intersected by the rotating shaft extending in an axial direction, and being provided adjacent to the lower stage pump chamber, and a side cover which covers the side face with the communication hole to form a space, wherein an outer face of the side cover is formed with an uneven section.

2. The dry pump according to claim 1, wherein the communication hole communicates the space with a pump chamber having a maximum pressure among the plurality of the pump chambers each having different inner pressures.

3. The dry pump according to claim 1, wherein the space is defined by the side face and a recessed portion which is formed on the side cover.

4. The dry pump according to claim 1, wherein the space is defined by the side cover and a recessed portion which is formed on the side face.

* * * * *